US005090685A

United States Patent [19]

Danon et al.

[11] Patent Number: 5,090,685

[45] Date of Patent: Feb. 25, 1992

[54] METHOD AND APPARATUS FOR SECURING A SHEET MATERIAL TO A ROTATING VACUUM DRUM USING A SEALING STRIP

[75] Inventors: Haim Danon, Kiriat Ono; Amir Gnessin, Tel-Aviv, both of Israel

[73] Assignee: Optrotech Ltd., Nes/Ziona, Israel

[21] Appl. No.: 591,620

[22] Filed: Oct. 2, 1990

[51] Int. Cl.[5] ..... B65H 5/22

[52] U.S. Cl. ..... 271/276; 271/196; 354/344; 355/73

[58] Field of Search ..... 271/112, 194, 196, 275, 271/276; 354/312, 315, 340, 344; 355/73, 76

[56] References Cited

U.S. PATENT DOCUMENTS

| | | | |
|---|---|---|---|
| 2,752,154 | 6/1956 | Nelson | 271/196 |
| 3,942,788 | 3/1976 | Boyle | 271/196 X |
| 3,998,449 | 12/1976 | Hornung | 271/112 |
| 4,029,537 | 6/1977 | Kish | 271/196 X |
| 4,037,718 | 7/1977 | Stiller | 354/344X |
| 4,056,057 | 11/1977 | Smith | 271/276 X |
| 4,504,843 | 3/1985 | Prohl et al. | 271/276 X |
| 4,660,825 | 4/1987 | Umezawa | 271/276 |
| 4,666,145 | 5/1987 | Blumle | 271/276 |
| 4,688,784 | 8/1987 | Wirz | 271/196 X |
| 4,707,123 | 11/1987 | Ueyama | 355/73 |
| 4,739,361 | 4/1988 | Roy et al. | 355/73X |
| 5,028,043 | 7/1991 | Karolyi | 271/276X |
| 4,740,813 | 4/1988 | Roy | 271/276 X |

FOREIGN PATENT DOCUMENTS

| | | | |
|---|---|---|---|
| 3644048 | 6/1988 | Fed. Rep. of Germany | 271/112 |

*Primary Examiner*—D. Glenn Dayoan
*Assistant Examiner*—Boris Milef
*Attorney, Agent, or Firm*—Helfgott & Karas

[57] ABSTRACT

In a drum having a flexible sheet material removably held on to an outer surface thereof, a method for reducing aerodynamic lift of an edge of the material, comprising the step of introducing a thin sealing strip between the outer surface of the drum and an inner surface of the film at the edge of the material. The lift may be caused by the natural tendency of the sheet material to curl at its edges and may be exacerbated by the flow of air under the edges as the drum rotates.

21 Claims, 1 Drawing Sheet

METHOD AND APPARATUS FOR SECURING A SHEET MATERIAL TO A ROTATING VACUUM DRUM USING A SEALING STRIP

FIELD OF THE INVENTION

The invention relates to a method for securing a sheet material to a rotating drum. In particular, it relates to such a method whereby aerodynamic lift of the sheet material owing to rotation of the drum is minimized.

BACKGROUND OF THE INVENTION

Printing devices are known which employ a drum to whose outer surface is secured a flexible data carrier on which an image is to be written. Thus, for example, photo plotters may include a drum having attached thereon a photographic film which is exposed to a light source as the drum rotates. In high speed laser plotters, for example, the speed of rotation of the drum can often be sufficiently high that there exists a tendency for the film to be lifted from the drum at one or both of the leading and trailing edges of the film. The forces which tend to cause the film to lift from the surface of the drum include centrifugal and aerodynamic lift forces as well as natural bending forces within the film itself.

As soon as an edge of the film starts to lift from the surface of the drum, there is created a pocket into which air can flow, either directly at a leading edge or on account of turbulence at a trailing edge. In either case, the inflow of air tends to lift the film even further from the surface of the drum.

Typically, photographic films and the like are secured to the rotating drum by means of suction applied through apertures provided in the shell of a hollow drum. In order to overcome, or at least minimize, the effect of edge lift of the film, it is known to employ mechanical fixing means at each edge of the film. However, this increases the set-up time as well as the time for removing the film from the drum after exposure. Another approach is simply to increase the strength of the vacuum producing the suction. However, this requires correspondingly larger compressors and clearly increases the cost of the resulting system. Furthermore, increasing the vacuum in this manner, can result in the film being partially sucked through the drum apertures, thus causing distortion of the film where it overlies the apertures. Such distortion causes the image at these points to be defocused and is clearly undesirable.

Although the lift effect described above is clearly exacerbated as the speed of rotation is increased, it exists even when the drum is stationary if the film is secured thereto by suction. This is because any natural tendency which the film may have to lift from the drum at its edges permits air to enter, thereby reducing the strength of the suction at the edges and increasing the lift effect.

SUMMARY OF THE INVENTION

It is an object of the invention to provide a method for securing a flexible sheet material to an outer surface of a rotating drum, such that aerodynamic lift of the sheet material from the drum is minimized.

According to the invention there is provided in a drum having a flexible sheet material removably held on to an outer surface thereof, a method for reducing aerodynamic lift of an end edge of the sheet material, comprising the step of introducing a thin sealing strip between the outer surface of the drum and an inner surface of the sheet material at said end edge.

It will be apparent that the introduction of a thin sealing strip between the outer surface of the drum and an edge of the sheet material itself lifts the sheet material from the surface of the drum and would thus appear to be counter-productive. However, in practice, it is found that the sealing strip prevents air from flowing into any pocket which might be caused as a result of aerodynamic lift of an edge of the film from the surface of the drum, and thus prevents the regenerative effective explained above whereby, once an edge of the film starts to lift, air can flow into the pocket thus formed thereby tending to increase the lift effect. It is conjectured that the introduction of the sealing strip within the pocket acts to seal the pocket, thereby reducing the further inflow of air and thus reducing aerodynamic lift.

BRIEF DESCRIPTION OF THE DRAWINGS

For a clearer understanding of the invention and to understand how the same may be carried out in practice, reference should be made, by way of non-limiting example only to the following drawings, in which.

DETAILED DESCRIPTION OF A PREFERRED EMBODIMENT

Figure 1:
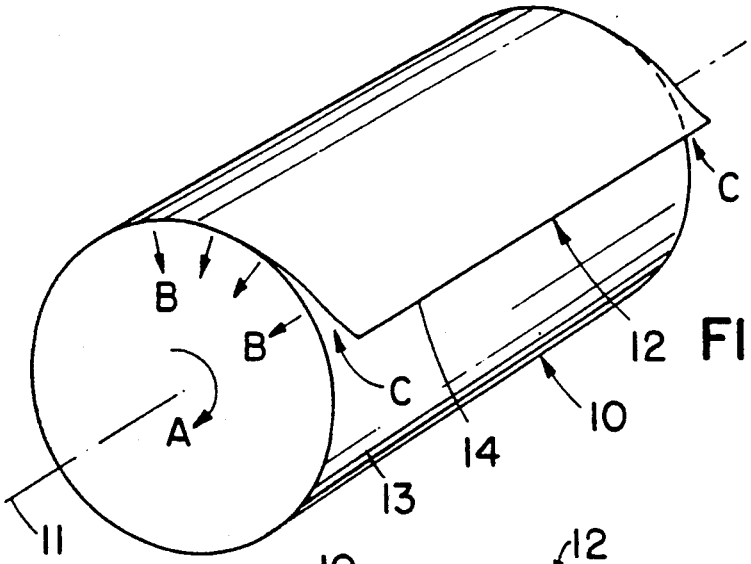
FIG. 1 shows a perspective view of a drum having a flexible film secured to its outer surface.

Referring to FIG. 1 there is shown a drum 10 which rotates in the direction of arrow A about an axis 11. The drum 10 comprises a substantially cylindrical hollow shell having a plurality of apertures therein (not shown) through which suction may be applied in the direction of arrows B so as to secure a photographic film 12 (constituting a flexible sheet material) on to an outer surface 13 of the drum 10.

Owing to the rotation of the drum 10, there exists a tendency for a leading edge 14 of the film 12 to become lifted from the outer surface 13 of the drum 10 by means of air passing underneath the film 12 so as to create an aerodynamic lift force in the direction of arrows C.

It should be noted that the trailing edge (not shown) of the film 12 will be lifted in like manner owing to the effect of turbulence at the trailing edge causing air to pass underneath the film in an analogous manner to that explained above.

Figure 2:
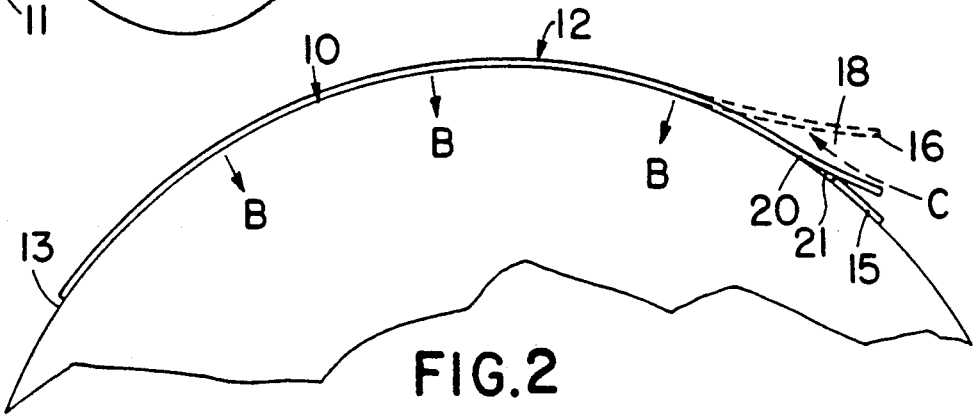
FIG. 2 is a cross-section of the drum on an enlarged scale showing the effects of lift at a leading edge of the film.

FIG. 2 shows an enlarged cross-section of a portion of the drum 10 wherein there is introduced a thin sealing strip 15 between the outer surface 13 of the drum 10 and an inner surface 16 of the film 12 at the leading edge 14. In dotted outline is shown the contour of the leading edge 14 of the film 12 when the sealing strip 15 is absent, owing to rotation of the drum 10 in the direction of arrow A. Thus, it will be seen that without the sealing strip 15, the film 12 tends to lift at its leading edge 14 thus creating a pocket 18 into which air can enter in the direction of arrow C, thus tending to increase the depth of the pocket 18.

However, the effect of the sealing strip 15 is to seal the pocket 18 such that air can no longer enter therein, thereby ensuring that the inner surface 16 of the film 12 rests firmly on the sealing strip 15.

In FIG. 2 it will be seen that there is formed a wedge-shaped opening 20 bound by the outer surface 13 of the drum 10, the sealing strip 15 and the inner surface 16 of the film 12 before it is secured flush with the outer surface 13 of the drum 10. The effect of the wedge-shaped opening 20 is to allow air to leak therethrough and diminish the strength of the vacuum. In order to overcome this problem, a pair of wedge-shaped sealing strips 21 are introduced at opposite ends of the opening 20 so as to prevent air from entering through the opening 20 at either end thereof.

Figure 3:
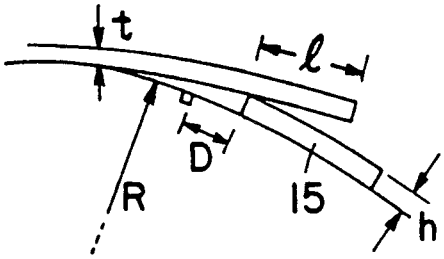
FIG. 3 is a detail of the drum shown in FIG. 2 useful for relating the thickness of a sealing strip to the physical properties of the film and the dimensions associated therewith.

Referring now to FIG. 3, it has been shown experimentally that the thickness h of the sealing strip 15 is determined according to the function:

$$h=f(R,t,E,l,D,C)$$

where:

R=radius of the drum
t=thickness of sheet material
E=Young's Modulus of sheet material
l=length of a free edge of the sheet material overhanging said sealing strip
D=distance between closest edge of sealing strip and nearest aperture, and
C=natural curvature of sheet material.

In a preferred embodiment, the following dimensions were employed:

h=0.3 mm
R=175 mm
t=0.2 mm
E=420 Kg/mm$^2$
l=1.5 mm
D=1.0 mm
C=800 mm.

Figure 4:
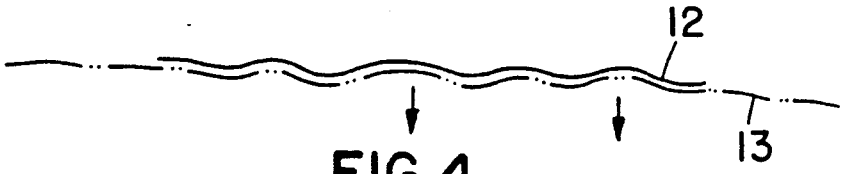
FIG. 4 is a pictorial representation of a section of the surface of the drum, showing the effect on the contour of the film of imperfections in the drum in hitherto proposed systems.

FIG. 4 shows pictorially, on an enlarged scale, the effect of imperfections in the outer surface 13 of the drum 10 for very high suction forces. It will be clear that for high suction forces the contour of the film 12 matches exactly the contour of the outer surface 13 of the drum 10, thus causing the resulting image to be distorted. In practice, the imperfections within the outer surface 13 of the drum 10 may simply be the result of the apertures provided therein for applying the suction force therethrough. In this case, too high a suction force tends to draw the film 12 into the apertures (not shown) causing the resulting photographic image to be distorted wherever the film 12 is aligned with the apertures.

Figure 5:
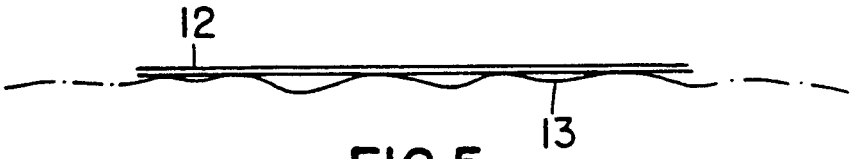
FIG. 5 is a pictorial representation of a section of the surface of the drum, showing the effect on the contour of the film of imperfections in the drum according to the invention.

FIG. 5 is a pictorial representation showning the result of imperfections in the outer surface 13 of the drum 10 when the film 12 is secured thereto according to the invention. As a result of the sealing strip 15, a much lower vacuum force may be applied for securing the film 12 to the durm 10, whereby the film 12 is no longer sucked into the imperfections (or apertures) within the outer surface 13 of the drum, thus preventing distortion of the resulting photographic image.

The invention thus provides a simple and inexpensive means for securing a flexible sheet of material to a rotating drum, such that the effect of aerodynamic lift at the leading and trailing edges of the sheet material are reduced consequent to rotation of the drum. Whilst the preferred embodiment has been described with specific reference to a laser plotter employing photographic film, it will be clear that the invention has more general application wherever flexible sheet material such as films, paper and the like is required to be supported on a rotating drum.

In the preferred embodiment, vacuum leakage at the edges of the film is reduced by wedge-shaped sealing strips. However, an alternative approach is simply to provide one or more additional vacuum apertures at the edges of the film so that the suction at the edges is increased.

We claim:

1. In a drum having a flexible sheet material removably held on to and in direct contact with an outer surface thereof, a method for reducing aerodynamic lift of an end edge of the sheet material, comprising the step of introducing a thin sealing strip above the outer surface of the drum and between the outer surface of the drum and an inner surface of the sheet material at said end edge.

2. The method according to claim 1, wherein said lift is at least partly due to rotation of the drum.

3. The method according to claim 2, wherein said end edge is a leading edge.

4. The method according to claim 2, wherein said end edge is a trailing edge.

5. The method according to claim 1, wherein the sheet material is secured to the drum by suction.

6. The method according to claim 5, wherein said lift is at least partly due to air leakage at said end edge.

7. The method according to claim 6, further including the step of introducing a pair of wedge shaped sealing strips at respective side edges of the sheet material abutting said end edge so as to limit air leakage between said side edges and the surface of the drum.

8. In a drum having a flexible sheet material removably held on to and in direct contact with an outer surface thereof, the improvement whereby there is provided a thin sealing strip above the outer surface of the drum and between the outer surface of the drum and an inner surface of the sheet material at an end edge of said sheet material so as to reduce aerodynamic lift of said end edge.

9. The drum according to claim 8, comprising:

a substantially cylindrical hollow shell having a plurality of apertures therein, and vacuum means for applying suction through said apertures for retaining the sheet material on the outer surface of the drum.

10. The drum according to claim 9, further including a pair of wedge shaped sealing strips at respective side edges of the sheet material abutting said end edge.

11. The drum according to claim 9, wherein there is provided a greater density of said apertures in a region of said end edge so as to increase the suction at said end edge.

12. In a rotatable drum having a flexible material sheet removable held on and in direct contact with an outer surface thereof, a method for reducing aerodynamic lift of an end edge of the sheet, generated upon actuation of the drum, the method comprising the steps of providing a thin sealing strip at said end edge of said sheet, and introducing said sealing strip into a pocket produced between said outer surface and an inner surface of said sheet at said end edge during rotation of the drum to thereby prevent air from entering said pocket and thus minimize aerodynamic lift of said end edge.

13. The method according to claim 12, wherein said end edge is a leading edge.

14. The method according to claim 12, wherein said end edge is a trailing edge.

15. The method according to claim 12. wherein the flexible material sheet is secured to the drum by suction.

16. The method according to claim 15, wherein said lift is partly due to air leakage at said end edge.

17. The method accordind to claim 16, and further comprising the step of introducing a pair of wedge shaped sealing strips at respective side edges of the sheet material abutting said end edge so as to limit air leakage between said side edges and outer surface of the drum.

18. In a drum having a flexible material sheet removably held on an in direct contact with an outer surface thereof, the improvement comprising a thin sealing strip introduced between the outer surface of the drum and an inner surface of the sheet at an inner end edge of said sheet, so that said sealing strip prevents air from entering a pocket produced between said outer surface and said inner surface of the sheet at said end edge during operation of the drum to thereby reduce aerodynamic lift of said end edge.

19. The drum according to claim 18, comprising:

a substantially cylindrical hollow sheet having a plurality of apertures therein, and vacuum means for applying suction through said apertures for retaining the sheet material on the outer surface of the drum.

20. The drum according to claim 19, and further comprising a pair of wedge shaped sealing strips at respective side edges of the sheet abutting said end edge.

21. The drum according to claim 19, wherein there is provided a greater density of said apertures in a region of said end edge so as to increase the suction at said end edge.

* * * * *